US010619367B2

(12) United States Patent
Vervoort

(10) Patent No.: US 10,619,367 B2
(45) Date of Patent: Apr. 14, 2020

(54) COVER FOR A SWIMMING POOL OR WHIRLPOOL BATH AND SWIMMING POOL OR WHIRLPOOL BATH THAT IS PROVIDED THEREWITH

(71) Applicant: TECHNICS & APPLICATIONS, AFGEKORT T&A, BESLOTEN VENNOOTSCHAP MET BEPERKTE AANSPRAKELIJKHEID, Geel (BE)

(72) Inventor: Ludo Jozef Vervoort, Lier (BE)

(73) Assignee: TECHNICS & APPLICATIONS, AFGEKORT T&A, BESLOTEN VENNOOTSCHAP MET BEPERKTE AANSPRAKELIJKHEID, Geel (BE)

( * ) Notice: Subject to any disclaimer, the term of this patent is extended or adjusted under 35 U.S.C. 154(b) by 42 days.

(21) Appl. No.: 15/738,501

(22) PCT Filed: Jun. 10, 2016

(86) PCT No.: PCT/BE2016/000025

§ 371 (c)(1),
(2) Date: Dec. 20, 2017

(87) PCT Pub. No.: WO2016/205901

PCT Pub. Date: Dec. 29, 2016

(65) Prior Publication Data

US 2018/0187440 A1 Jul. 5, 2018

(30) Foreign Application Priority Data

Jun. 23, 2015 (BE) ..... 2015/5380

(51) Int. Cl.
*E04H 4/08* (2006.01)

(52) U.S. Cl.
CPC ..... *E04H 4/082* (2013.01)

(58) Field of Classification Search
CPC ..... E04H 4/082; E04H 4/10; E04H 4/101
See application file for complete search history.

(56) References Cited

U.S. PATENT DOCUMENTS 3,885,255 A * 5/1975 Vorbach ..... E04H 4/101 4/502
4,466,143 A 8/1984 Lamb
(Continued)

FOREIGN PATENT DOCUMENTS

| | | |
|---|---|---|
| EP | 2 690 236 A1 | 1/2014 |
| FR | 2 948 396 A1 | 1/2011 |
| WO | 2014/190399 A1 | 12/2014 |

OTHER PUBLICATIONS

International Search Report, dated Sep. 27, 2016 from corresponding PCT application No. PCT/BE2016/000025.

*Primary Examiner* — Janie M Loeppke
(74) *Attorney, Agent, or Firm* — Young & Thompson

(57) ABSTRACT

Cover for a swimming pool or whirlpool bath, whereby the cover includes a rollup screen whereby the screen has two side edges and whereby the screen has a first edge perpendicular to the side edges and a second edge perpendicular to the side edges, whereby the cover includes a rollup shaft, whereby the first edge of the screen is connected to the rollup shaft and whereby the screen can be rolled up and rolled out on the rollup shaft, whereby the rollup shaft is horizontally movable so that the screen can be rolled out while the second edge is in a fixed position and whereby the cover is provided with a unit to exert a rotational force on the rollup shaft to thereby roll up the screen.

18 Claims, 7 Drawing Sheets

(56) References Cited

U.S. PATENT DOCUMENTS

| | | | | |
|---|---|---|---|---|
| 2011/0119823 | A1 | 5/2011 | Coenraets | |
| 2011/0308003 | A1* | 12/2011 | Scali | E04H 4/082 4/498 |
| 2014/0000021 | A1* | 1/2014 | Scheps | E04H 4/101 4/498 |

* cited by examiner

COVER FOR A SWIMMING POOL OR WHIRLPOOL BATH AND SWIMMING POOL OR WHIRLPOOL BATH THAT IS PROVIDED THEREWITH

BACKGROUND OF THE INVENTION

Field of the Invention

The present invention relates to a cover for a swimming pool or whirlpool bath and a swimming pool or whirlpool bath that is provided therewith. Furthermore, for clarity we will mainly discuss whirlpool baths, but the cover is also suitable for covering swimming pools.

More specifically the invention relates to covers with a screen of lamellae connected together. In general they have the advantage that they are relatively rigid, but nevertheless form a screen that can be rolled up so that a whirlpool bath can be covered to counteract heat loss, to prevent children or animals being able to fall therein, and to prevent contaminants getting in there.

It is particularly, but not only, of importance for whirlpool baths installed outside.

Description of the Related Art

With the traditional use of them the screen is manually or automatically rolled out and rolled up, whereby the screen slides along the edge of the whirlpool bath. Especially with whirlpool baths, but also with swimming pools, this sliding movement causes damage to the edge of the whirlpool bath and possibly also to the screen itself, for example due to sand that is on the edge.

It is of course possible to provide guides for this purpose and to mount them on or above the edge of the whirlpool bath, but this means an additional cost and it also interferes with a smooth rounded finish of the edge.

The drive of the screen is hereby difficult because a motor will have to overcome the force of friction and thus will have to be constructed very strongly.

Such a screen is for example disclosed in WO 2014/0190399 wherein the side edges of the screen are slidingly guided in rails on the edges of the pool to be covered, the screen being rolled up and rolled out from a rollup shaft which is supported in a raised position by a supporting frame.

In FR 2.948.396 a screen is disclosed with a similar supporting frame, but where the screen is supported by the water in the pool, the pool not being completely covered by the screen because of a gap between the screen and the edges of the pool, allowing heat of the water in the pool to escape, especially at the end of the screen where the width of the gap can change because of the movement of the screen due to the movement of the water on which it is resting.

A further problem that occurs is that in general few disinfectant products are used with whirlpool baths and the temperature is also high, typically approximately 38° C., such that the risk of the undesired growth of micro-organisms is high. For this reason, a cover for a whirlpool bath has to be watertight so that no rainwater or cleaning water can leak through the covering.

Ice formation is also a potential problem. With ambient temperatures below freezing point, water vapour that is between the edge of a whirlpool bath and a screen can evade freezing so that, in this situation, the opening of the cover is difficult or cannot be done, or there is a risk of damage.

BRIEF SUMMARY OF THE INVENTION

The purpose of the present invention is to provide a solution to the aforementioned and other disadvantages by providing a cover for a swimming pool or whirlpool bath, whereby the cover comprises a rollup screen whereby the screen has two side edges and whereby the screen has a first edge perpendicular to the side edges and a second edge perpendicular to the side edges, whereby the cover comprises a rollup shaft, whereby the first edge of the screen is connected to the rollup shaft and whereby the screen can be rolled up and rolled out on the rollup shaft, whereby the rollup shaft is horizontally movable so that the screen can be rolled out while the second edge is in a fixed position and whereby the cover is provided with means to exert a rotational force on the rollup shaft to thereby roll up the screen.

This enables the screen to be rolled out without it sliding along the edge of the whirlpool bath and causing damage, for example due to the second edge of the screen being fastened on or near to an edge of the whirlpool bath and with the rollup shaft with the still rolled-up remainder of the screen being allowed to move along the edge, whereby the rollup shaft makes an essentially horizontal movement and the screen is placed over the edge of the whirlpool bath on this edge without horizontal movement.

Because the screen now rests on the edge, a very good seal is obtained.

Such a cover is very easy to install because it is only necessary to place the cover in a rolled-up position on an edge of the whirlpool bath and to fasten the second edge of screen on this edge, or at another the fixed point, after which the cover can be used.

The cover thus needs no rails or other guides to be able to work, so that nothing has to be mounted on or next to an edge of the swimming pool or whirlpool bath that could interfere with the users of the swimming pool or whirlpool bath.

The cover can for example be made wider than the outer dimensions of the swimming pool or whirlpool bath.

Preferably the screen is made of lamellae that each have two ends, whereby the lamellae are connected together with a sideways hinge, whereby the said two side edges are formed by the ends of the lamellae.

For clarity it is noted that the ends of the lamellae means the ends in the longitudinal direction of the lamellae, in other words the end-on sides of the lamellae.

Preferably the cover is a cover for a whirlpool bath with a top edge that is at least 50 cm above ground level.

In a preferred embodiment, during a rollup movement or rollout movement, the rollup shaft rests on the entire or partial rolled-up screen, in other words the rollup shaft is entirely or essentially supported by the screen.

The means to exert a first rotational force can essentially consist of a motor or a spring, but can also consist of a simple handle that is fastened to the rollup shaft and which can be manually operated.

In a preferred embodiment the cover is provided with a spring that is tensioned by a rollup movement or rollout movement of the screen so that the force required for the reverse movement can be entirely or partially supplied by the tension of the spring.

This has the advantage that the construction can be made simpler as a result.

In another preferred embodiment the cover contains an electric motor with a rotor to drive the rollup shaft and a stator, whereby the stator is connected via a first arm to a first support that is affixed to a side edge of the screen and which is movable along this side edge, i.e. is slidable or rollable on this side edge.

Here the previously mentioned means for exerting a rotational force on the rollup shaft are formed by the electric motor.

This first support is affixed to the said side edge in such a way that it is only movable along the side edge, but is further immovably connected thereto.

In this way a rotational movement of the stator can be prevented, so that he rotor can deliver the required torque to the rollup shaft.

This can thus be done without the first support having to be fastened to a fixed mounted guide. Hereby the weight of the lamellae thus provides sufficient torque to prevent the rotation of the stator and thus the possibility that the rotor can rotate the rollup shaft.

This can alternatively be described by one or more of the following characteristics:

- the rotor is connected to the rollup shaft in a rotational force-transmitting way in order to drive the rollup shaft during a rollup movement whereby the stator is not rotatable with respect to the first support, whereby preferably the first support is affixed around a side edge of the screen;
- the first support is at least partially under the said side edge so that the first support is blocked by the said side edge in relation to an upward movement;
- the first support is only connected to other components of the cover, and is thus not connected to an object that does not form part of the cover;
- the cover does not comprise a rigid linear guide for guiding a horizontal movement of the first support.

If the stator is connected to a fixed point, this is done in the most obvious way. The arm must be of a variable length here.

If the stator is fastened to the said support this is done by means of the weight of the lamellae, that are coupled together and thereby can withstand a sufficiently large force.

In another preferred embodiment the rollup shaft is hollow and the motor is affixed in the rollup shaft. As a result the motor is well protected and a compact construction is obtained.

Preferably the cover is hereby provided with a brake for braking a rotation of the rollup shaft with respect to the stator during a rollout movement of the screen.

This is desirable because otherwise, during a rollout movement, windings of the screen can come loose around the rollup shaft. This leads to an irregular rollout behaviour and possibly even to damage.

In a preferred embodiment the rollup shaft is connected via a second arm to a second support that is affixed to a side edge of the screen and which is moveable over this side edge by means of at least one wheel, including a gearwheel, that is affixed to the second support and which grips on the side edge concerned of the screen and which is driven in the direction from the second edge to the first edge, and which thereby causes a rollout movement.

If the cover is provided with a spring that is tensioned by a rollup movement or rollout movement of the screen, the spring is preferably tensioned by a rollup movement of the screen and the at least one wheel is driven by the spring.

In another preferred embodiment the at least one wheel is driven by the rotor of the electric motor, whereby the electric motor is provided with a switched coupling to thereby drive the rollup tube or the at least one wheel alternately, depending on the direction of rotation of the rotor.

As a result, by means of a switched coupling, i.e. a coupling that drives a different component depending on the direction of rotation of the motor, both the rollup movement and the rollout movement are realised with only one motor.

Preferably the lamellae comprise lamella bodies that are sealed at their ends with caps, whereby the at least one wheel of the first support and/or the second support grips onto these caps.

In another preferred embodiment the lamellae essentially or only consist of lamella bodies that are sealed at their ends with caps, whereby the cover is provided with an electricity cable for the provision of an electricity supply at the electric motor, whereby this electricity cable runs through the caps.

In this way the electricity supply can be provided for the electric motor safely, and invisibly in practice.

In a preferred embodiment, the lamellae have a curve so that in the rolled-out position the screen has an incline down towards the side edges with an average angle between 0.5° and 3°, whereby the lamellae are sufficiently elastically deformable to be able to be placed in a straight position under tension.

As a result a good water drainage, and thus a small risk of the inflow of undesired water into the whirlpool bath, are obtained, whereby nonetheless, the screen can be rolled up compactly due to the deformability of the lamellae.

In another preferred embodiment the lamellae have a curve because they have lamella bodies that are made of plastic in which fibres are affixed under tension in the longitudinal direction of the lamella bodies. This can be done by means of the known pultrusion technique, whereby in this case the average tension of the fibres on the underside of the lamella bodies is greater than in the fibres on the top of the lamella bodies, so that the lamella bodies obtain a curve.

In another preferred embodiment the lamellae are provided with a thermally conductive layer on their underside that extends over at least a section of the longitudinal direction of the lamellae. As a result, during use of the cover, and if the conductive layer at least runs from a position above the water of the whirlpool bath to the place where the cover rests on the edge of the whirlpool bath, it prevents water vapour being able to freeze at this last-mentioned location.

In a further preferred embodiment the lamellae are constructed on their underside in a soft deformable plastic, for example a plastic foam such as polyurethane foam.

In addition to the fact that the lamellae are not moved horizontally along the edge, this prevents the lamellae causing damage to the edge of the whirlpool bath.

In another preferred embodiment, the lamellae are connected together in order to only be hinged upwards. this has the advantage that, as soon as one or a few lamellae are subject to an upward force, as happens for example when rolling up the screen, this force is transmitted to adjacent lamellae, so that a greater upward force can be withstood.

This is also safer because it is more difficult for people, for example children, to raise a section of the screen and thus the risk of accidents is reduced.

In a preferred embodiment the lamellae are coupled in a hinged way to one another by means of a non-extendable coupling of flexible plastic, whereby the lamellae have a maximum width and whereby the lamellae have this maximum width at a position under the said coupling.

This is an easy way to obtain the desired upward-only hinged behaviour.

The invention also concerns a swimming pool or whirlpool bath, whereby the swimming pool or whirlpool bath has edges, whereby the swimming pool or whirlpool bath is provided with a cover as defined above, whereby the cover is mounted such that the rollup shaft is horizontally movable, thus is not immovably fastened, in order to be able to roll up or roll out the screen over the edges of the swimming pool or whirlpool bath due to the horizontal movement of the rollup shaft while the second edge of the screen is held at a fixed position, preferably on or close to one of the edges of the swimming pool or whirlpool bath.

Preferably hereby, a first component of a closure is fastened on the first or the second support of the first or second arm, whereby a second component of the closure is fastened on the swimming pool or whirlpool bath, whereby the closure is arranged to block a vertical movement of the first component with respect to the second component by the first component being able to be introduced horizontally in or around or below the second component.

The first and second component can be a bolt and a clasp for example, or a fork and a pin with a wider head, or can be constructed in many other embodiments, as long as the first component can be introduced horizontally in or around or below the second component, so that the second component is blocked upwards.

As a result, in the rolled-out position of the screen, the screen can be protected against lifting, for example by children, which could yield a hazard or cause damage due to the wind.

BRIEF DESCRIPTION OF THE DRAWINGS

With the intention of better showing the characteristics of the invention, a few preferred embodiments of a cover according to the invention are described hereinafter by way of an example, without any limiting nature, with reference to the accompanying drawings, wherein.

DETAILED DESCRIPTION OF THE PREFERRED EMBODIMENTS

Figure 1:
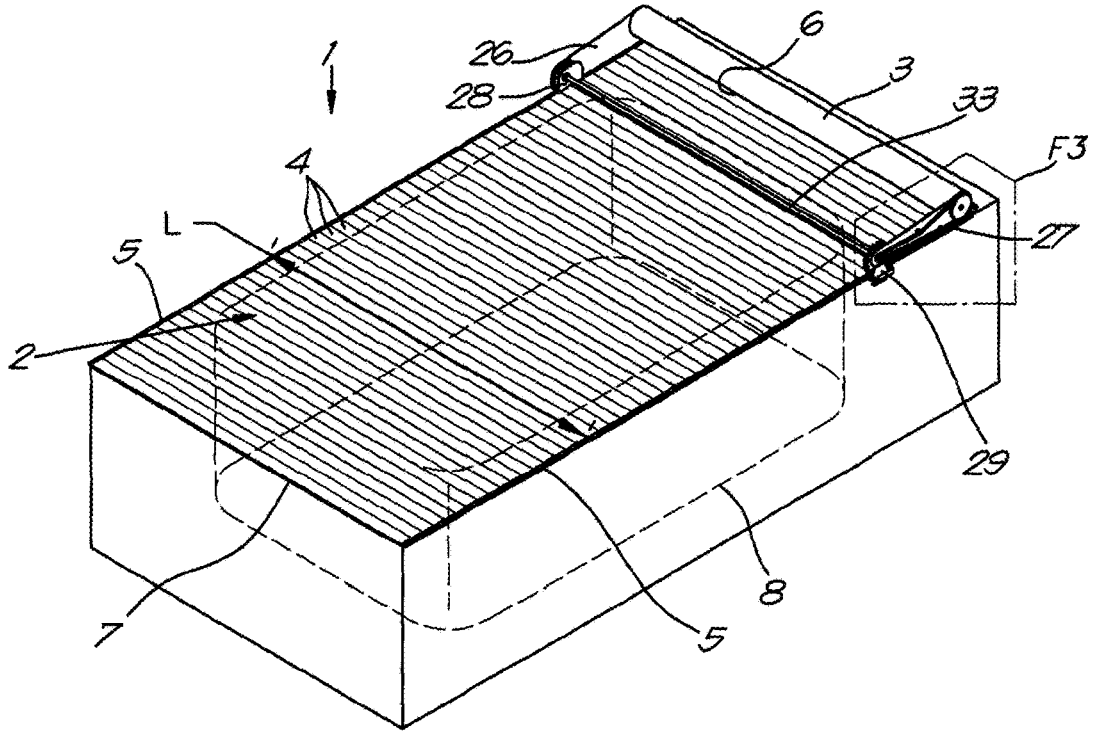
FIG. 1 schematically shows a perspective view of a cover according to the invention, mounted on a whirlpool bath, in a first usage position.

The cover 1 shown in FIG. 1 essentially consists of a screen 2 and a rollup shaft 3 on which the screen can be rolled up.

The screen 2 is made of lamellae 4 that each extend in a longitudinal direction L, and which are connected together with a sideways hinge.

The screen 2 has four edges, i.e. two side edges 5 that are formed by the ends of the lamellae 4 located next to one another, a first edge 6, that is formed by the side of a lamella 4 and which is fastened to the rollup shaft 3, and a second edge 7 that is located opposite the first edge 6.

The cover 1 is mounted on a whirlpool bath 8, whereby the second edge 7 of the screen 2 is fastened to an edge of the whirlpool bath 8.

The lamellae 4 are mutually identical and essentially consist of a polyester lamella body 9, a bottom layer 11, and two end caps 12. The lamella bodies 9 are made of polyester in which fibres are affixed in the longitudinal direction L. The lamella bodies 9 are curved, whereby they are higher in the middle than at the side edges 5 of the screen 2, whereby the average angle of the lamellae 4 with respect to the horizon is approximately 1°.

Such lamella bodies 9 can be produced by the known technique of pultrusion, whereby fibres under tension in the lamella bodies 9 are pulled along during the pultrusion, and whereby the fibres on the underside are under a higher tension than on the top. As a result of this the lamella bodies 9 obtain a slight curve.

The bottom layer 11 consists of an extruded PVC profile 13 on which a layer of polyurethane foam 14 is affixed. The PVC profile 13 and the lamella bodies 9 have a partially complementary form, so that they can be inserted into one another. A thin layer of aluminium 15 is affixed between the PVC profile 13 and the layer of polyurethane foam 14.

This layer of aluminium 15 does not extend, in any case not necessarily, across the entire length L of the lamellae 4, but only over the section of the lamellae 4 running from the ends of the lamellae 4 to above the whirlpool bath 8.

The lamellae 4 are connected together by means of couplings 17. These couplings 17 fit in grooves provided to this end in the lamella bodies 9, and consist of a dumb-bell shaped section 18 of flexible polyurethane with two PVC enclosures 19.

The end caps 12 close off the lamella bodies 9. The end caps 12 are also provided with vertical holes 21 placed at a regular distance from one another, and with horizontal holes 22 in which an electricity cable 23 is affixed that runs to the rollup shaft 3.

The maximum width B of the lamellae 5 is at a lower position than the couplings 17, and the couplings 17 are dimensioned such that the sides of the lamellae 4 lie against one another.

As a result, two lamellae 4 can only hinge upwards with respect to one another and the screen 2 can thus only be rolled up in an upward direction.

Figure 3:
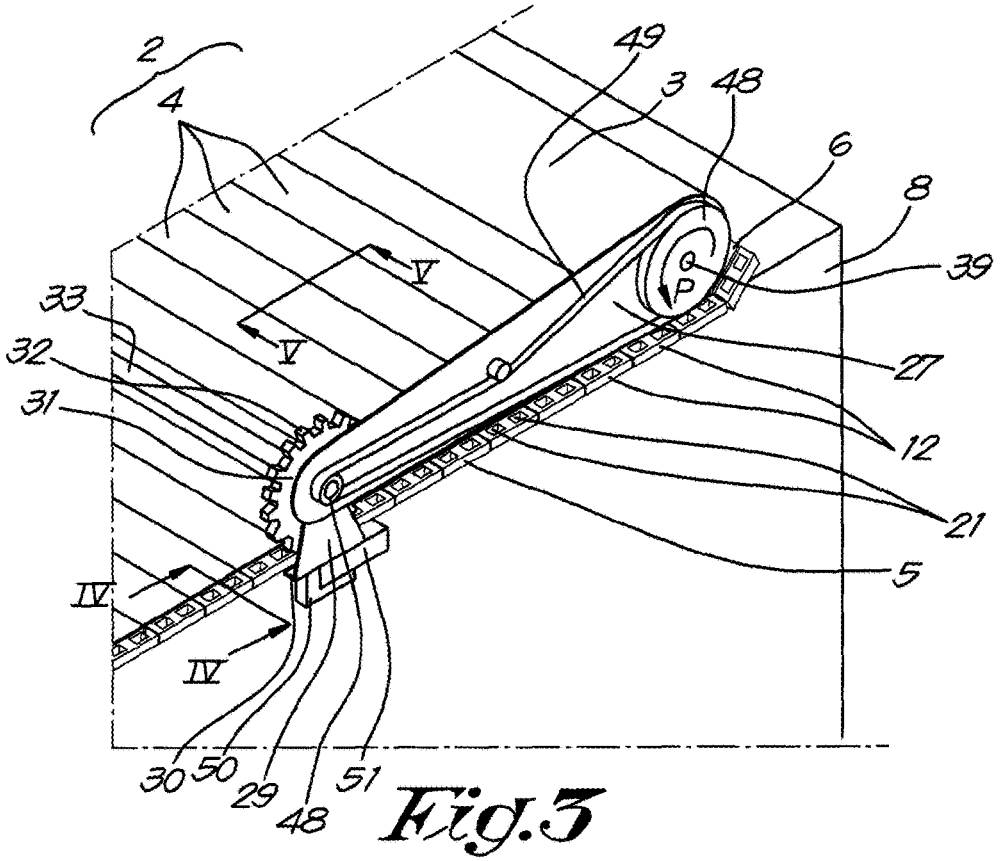
FIG. 3 shows the section of FIG. 1 indicated by F3 on a larger scale.
Figure 4:
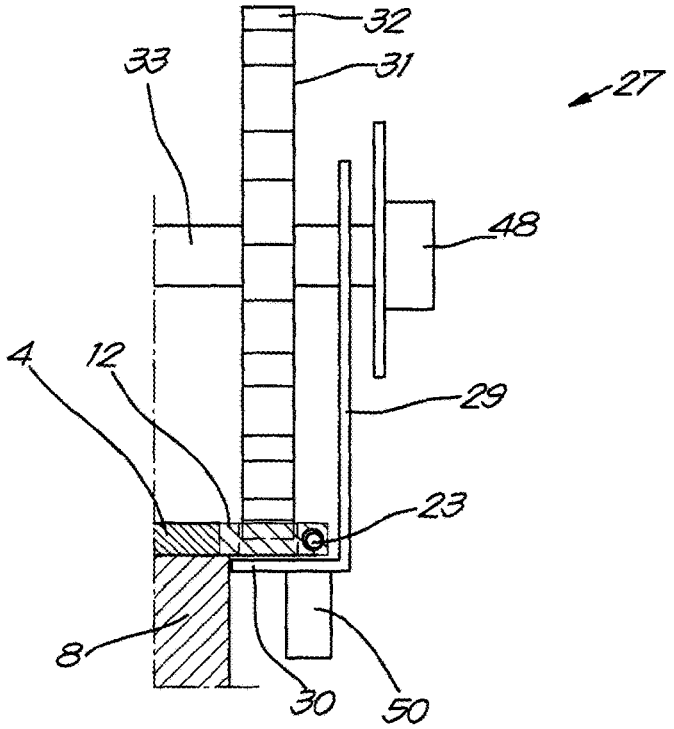
FIG. 4 shows a cross-section according to IV-IV of a section of the cover of FIG. 3.
Figure 5:
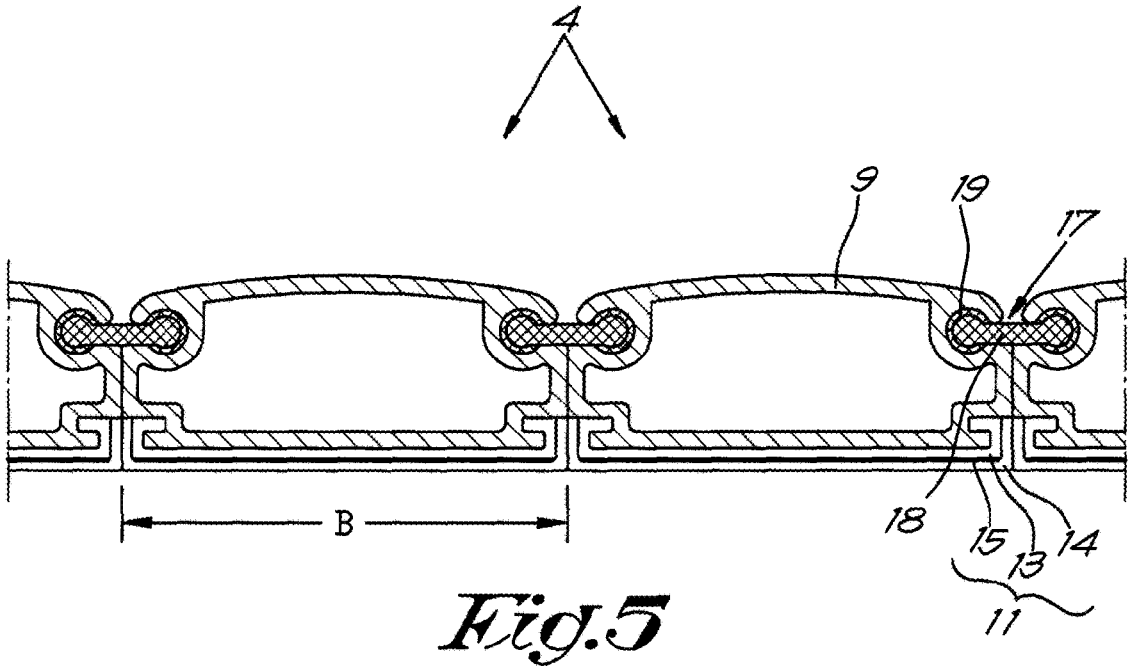
FIG. 5 shows a cross-section according to V-V of a section of the cover of FIG. 3.
Figure 6:
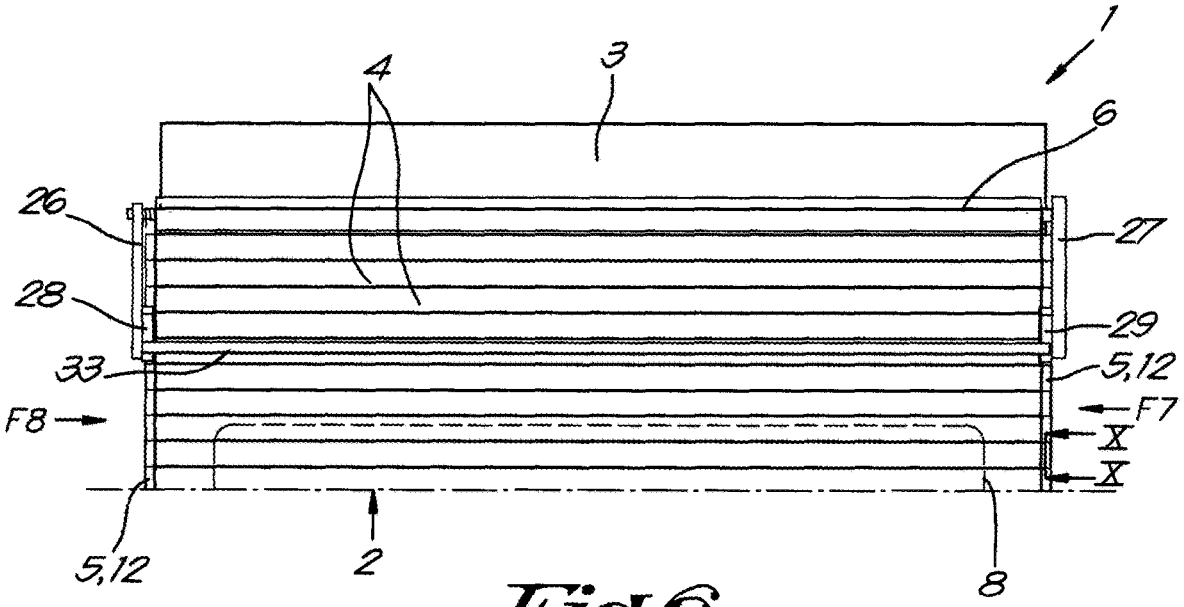
FIG. 6 shows a top view of a section of the cover of FIG. 1.
Figure 7:
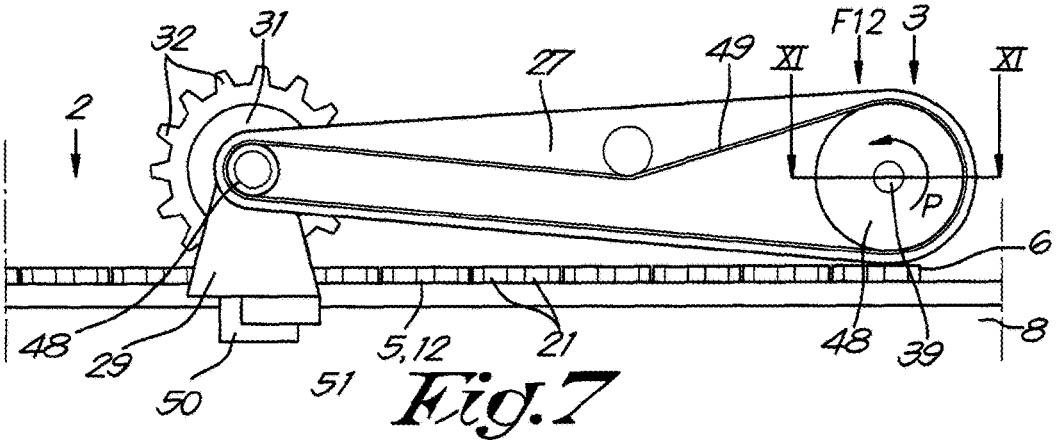
FIGS. 7 and 8 show a side view according to F7 and F8 respectively, of the section of FIG. 6.
Figure 8:
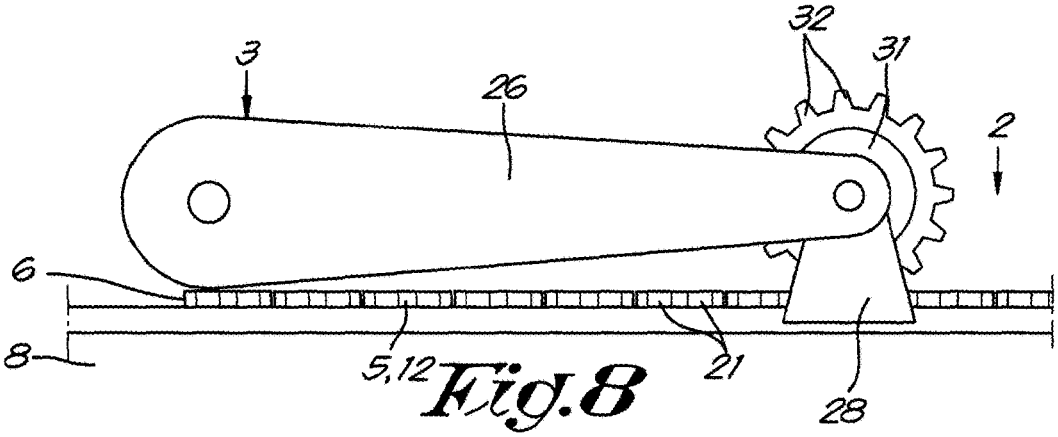
Figure 9:
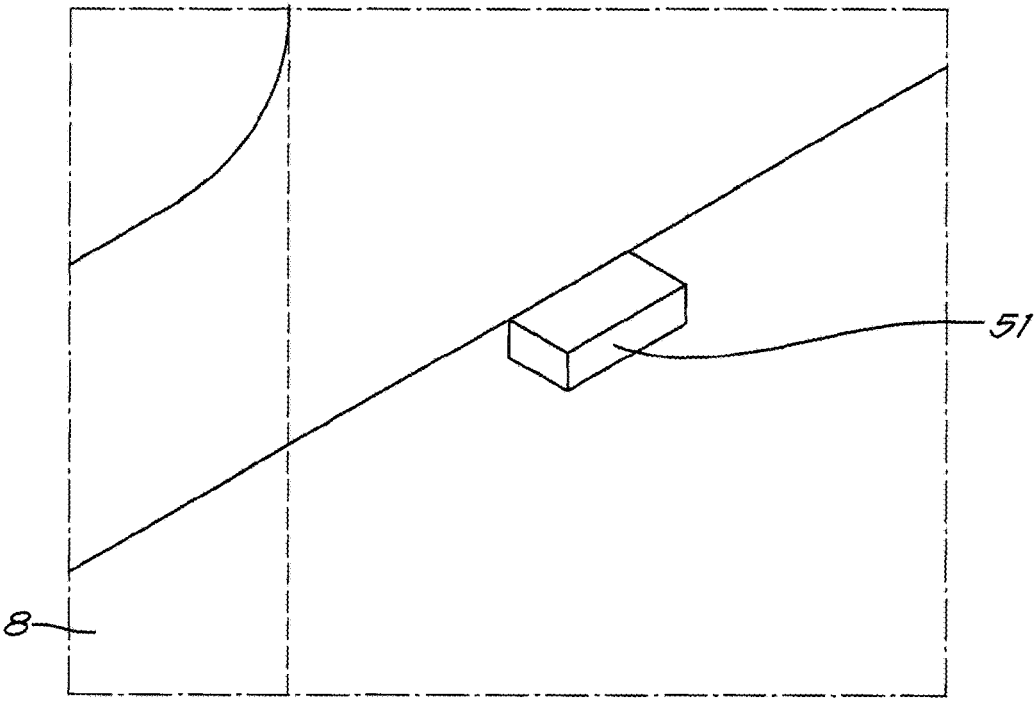
FIG. 9 shows the section van FIG. 2 indicated by F9 on a larger scale.
Figure 10:
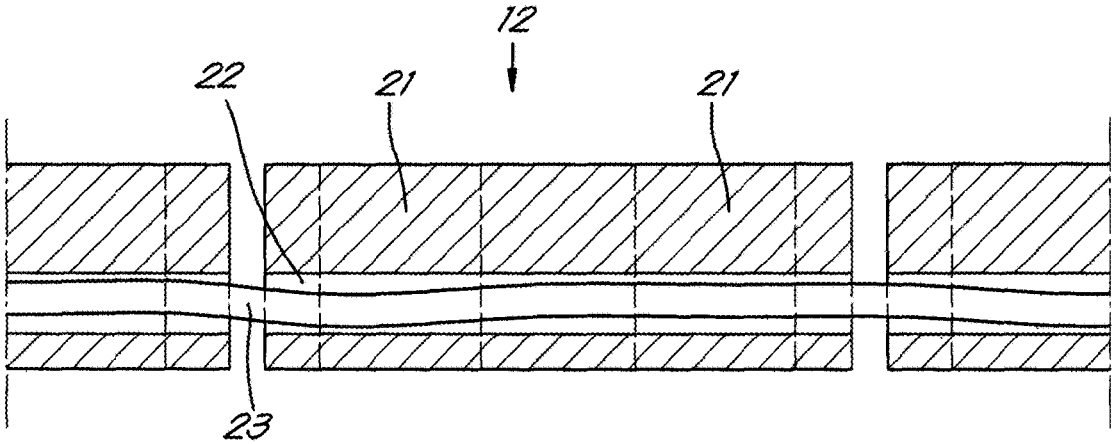
FIG. 10 shows a cross-section of a part of the cover as indicated by X-X in FIG. 6.
Figure 11:
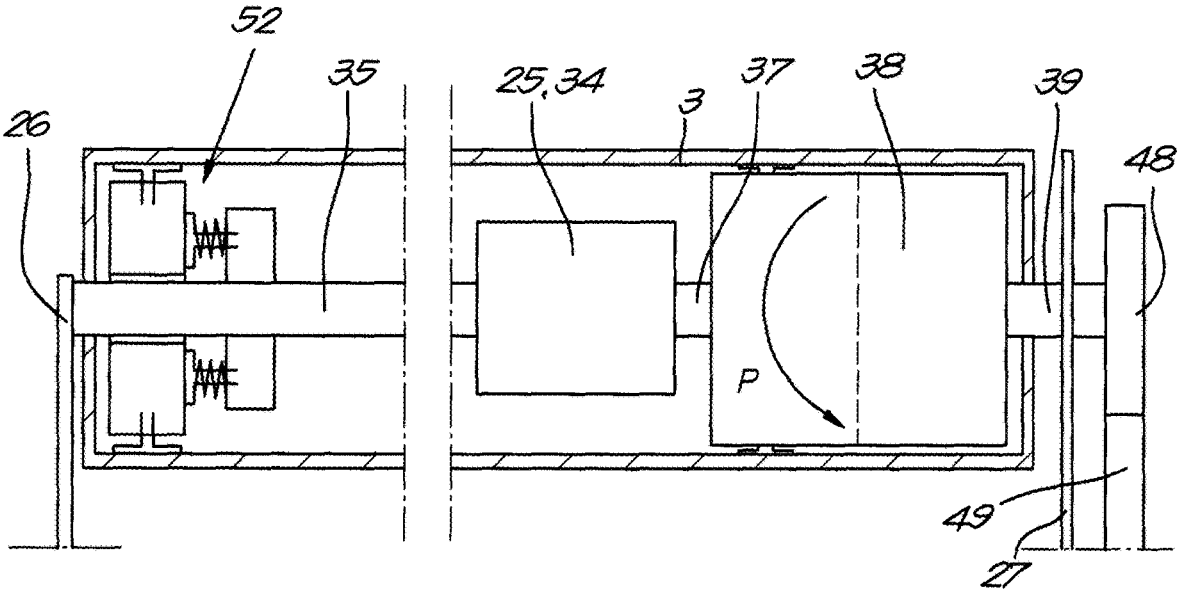
FIG. 11 shows a cross-section of a component of the cover according to XI-XI in FIG. 7.

The rollup shaft 3 is a hollow shaft, in which an electric motor 25 is affixed, and to which two arms are affixed, i.e. a first arm 26 and a second arm 27, that each end in a movable support that is affixed around a side edge 5 of the screen, i.e. a first support 28 at the first arm 26 and a second support 29 at the second arm 27. The supports 26, 27 are provided with a lip 30 that is below the side edge 5 and with a gearwheel 31 with teeth 32 that fit in the vertical holes 21 of the end caps 12. It is noted here that for illustration in FIGS. 3 and 4, the lip 30 is shown at the second support 29, but that there is also such a lip 30 at the first support 28.

The two gearwheels 31 are connected together via a connecting shaft 33.

The electric motor 25 is supplied by the electricity cable 23. This can be done by means of sliding contacts. Alternatively, because the number of rotations to be made is limited, a fixed connection can be used with a cable guide in the rollup shaft 3.

The first arm 26 is fastened to the stator 34 of the electric motor 25 by means of a connecting rod 35.

The rotor 37 of the electric motor 25 is provided with a switched coupling 38, which, if the rotor 37 turns in a first direction indicated by arrow P, drives the rollup shaft 3 and which, if the rotor 37 turns in the reverse direction, drives a drive shaft 39 that is rotatably fastened to the second arm 27.

The second arm 27 is thus fastened by means of the switched coupling 38 and the drive shaft 39 to the rollup shaft 3. This means that the rollup shaft 3 is rotatable with respect to the two arms 26, 27.

Figure 12:
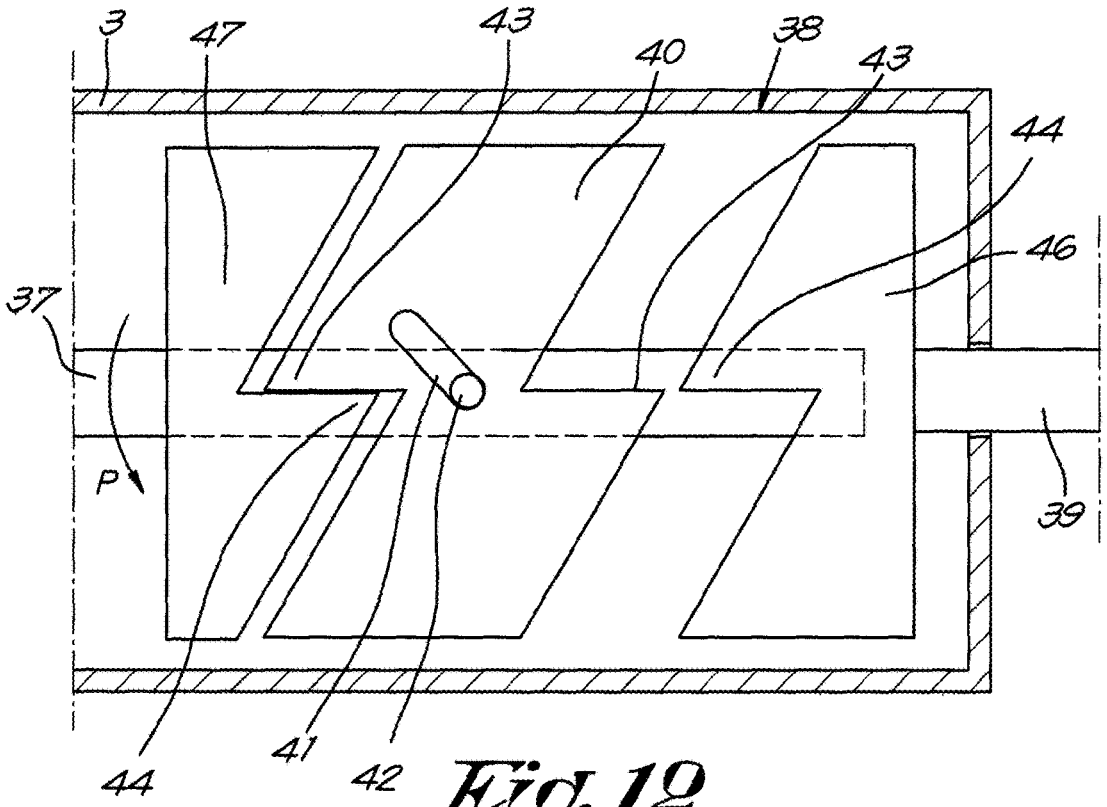
FIG. 12 shows a top view of a component of the cover according to F12, with a section cut away.

The switched coupling 38 is shown in detail in FIG. 12. This drawing shows a top view, whereby the rollup shaft 3 has been removed.

The switched coupling 38 comprises a switching piece 40, that is movable on the rotor 37, due to a slot 41 being placed obliquely in the switching piece in which a pin 42 is affixed that runs through the rotor 37.

The two end surfaces of the switching piece 40 are each provided with two teeth 43.

The switched coupling 38 also comprises two end plates 46, 47 placed at a distance from one another, that are also provided with teeth 44.

The first 46 of these end plates is coupled to the drive shaft 39, and the second 47 of these end plates is coupled to the rollup shaft 3.

The switched coupling 38 works because, depending on the direction of rotation of the rotor 37, the switching piece 40 is pulled against another end plate 46,47.

In the example shown in FIG. 12, when the rotor 37 is turned in the direction of arrow P, the switching piece 40 is pulled against the second end plate 47, such that the rollup shaft 3 is driven. If the rotor 37 turns in the reverse direction, the switching piece 40 is pulled against the first end plate 46 due to the switching piece being moved axially over the pin 42 that can slide in the slot 41, such that the drive shaft 39 is driven.

This drive shaft 39 drives, via two pulleys 48 on the second arm 27 and a drive belt 49, the gearwheel 31 of the second arm 27, and thus also the gearwheel 31 of the first arm 26 via the connecting shaft 33.

A hook 50 is fastened on the underside of the second support 29. When the screen 2 is rolled out a block 51 is affixed at a corresponding place on the whirlpool bath 8, to act as an endstop for the hook 50.

Internally in the rollup shaft 3 a brake 52 is affixed between the connecting rod 35 coupled to the stator 34 and the rollup shaft 3. This brake 52 is arranged such that it only brakes in one direction, i.e. the rollout direction of the rollup shaft 3, and freewheels in the other direction.

This can be done in a known way by mounting one of the braking parts via a freewheel bearing.

The operation of the cover 1 is simple and as follows.

Figure 2:
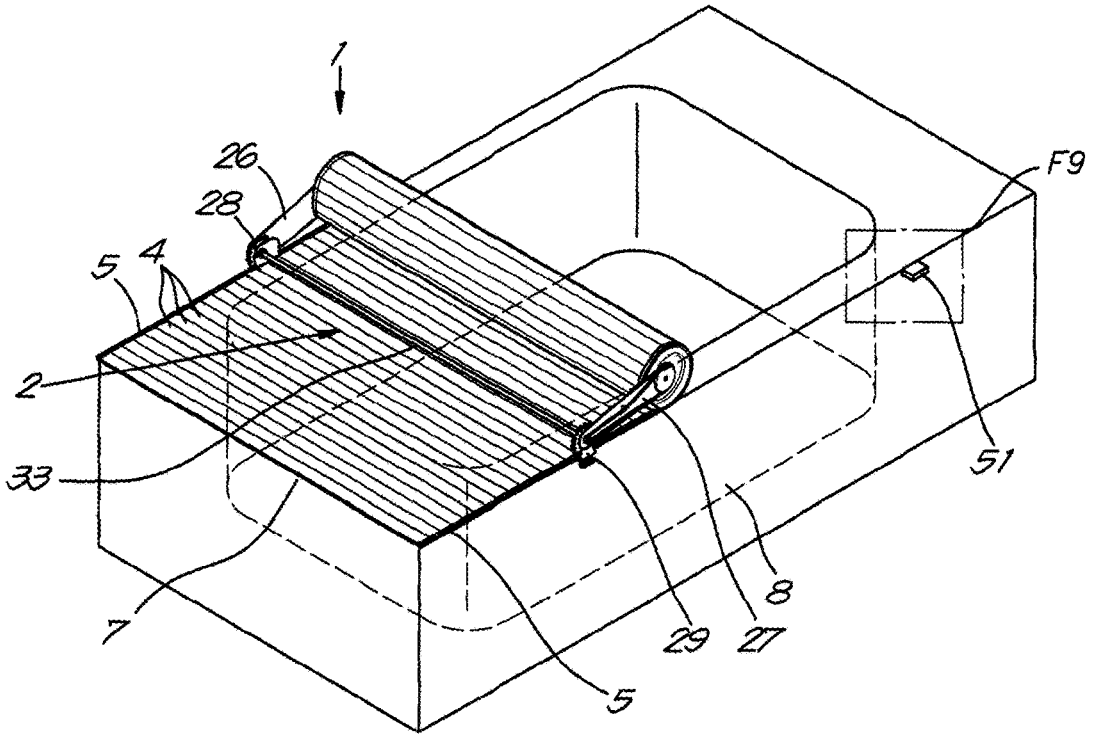
FIG. 2 shows the cover of FIG. 1 in a second usage position.

The cover 1 is placed on or near an edge of a whirlpool bath 8, in FIGS. 1 and 2 the foremost short edge, whereby the second edge 7 of the screen 2 is fastened to a fixed point, for example to the edge concerned of the whirlpool bath 8.

Now the electric motor 25 is brought into operation, in a direction in which the drive shaft 39 is driven thanks to the switched coupling 38. As a result the gearwheels 31 are brought into motion and these gearwheels 31 push the supports 28, 29 and thereby the arms 26,27 and the rollup shaft 3, in the direction of the opposite edge of the whirlpool bath 8. The gearwheels 31 hereby run with their teeth 32 in the vertical holes 21 in the end caps 12.

It is noted here that in this example both supports 28, 29 are driven. In principle it is sufficient that only the second support 29 is driven.

As a result of this the screen 2 is rolled out, whereby the rollup shaft 3 will rotate and move horizontally along the length of the whirlpool bath 8. In order to prevent an irregular rollout behaviour of the screen 2, the brake 51 brakes the rotational movement, so that during the entire rollout movement a certain tension always remains on the screen 2.

FIG. 2 shows the cover 1 in a situation during a rollout movement.

When the screen 2 is rolled out the electric motor 25 is stopped. This can be done manually, but also for example by means of an end switch, or by setting a maximum number of rotations, or by means of a control unit that determines the end point by means of the requested power.

Just before this end point is reached, the hook 50 slides under the block 51.

During and after the rollout movement the screen 2 rests on the edge of the whirlpool bath 8, but does not slide over it.

The whirlpool bath 8 is now covered, as shown in FIG. 1.

Due to the hook 50 and the block 51, the screen 2 cannot be lifted by the wind or by people at the first edge 6 of the screen 2, where the rollup shaft 3 is located.

This cannot be done either at places between the first and second edge 6,7, because the lamellae 4 are only hingable upwards with respect to one another. As a result, when lifting a few lamellae 4 at a side edge 5, the screen 2 acts as a rigid screen with a weight that is too great to be easily lifted.

The whirlpool bath 8 is now protected against the inflow of water, for example rainwater or cleaning water, and atmospheric dirt. Due to the completely closed construction of the lamellae 4 and the couplings 17, and the fact that the screen 2 has a curve, water runs quickly away from the screen 2, without seeping through into the whirlpool bath 8.

The hot water in the whirlpool bath 8 is protected against heat loss due to the insulating action of the screen 2.

Hereby a small heat flow is deliberately allowed to the underside of the lamellae 4 at the place where the screen 2 rests on the edge of the whirlpool bath 8, due to the layer of aluminium 15, to prevent freezing of water vapour originating from the whirlpool bath 8.

In order to roll up the screen 2 again the electric motor 25 is operated in the other direction. This brings the rollup shaft 3 into rotation, in a direction towards the second edge 7 of the screen 2.

As a result, a significant torque occurs on the stator 34. This is transmitted via the first arm 26 to the first support 28, which by means of the lip 30 pushes upward against the side edges 5 of the screen 2, so that the stator 34 is prevented from being able to rotate.

Because the gearwheels 31 are now not driven they freewheel, so that the supports 28, 29 can move along the side edges 5 of the screen 2.

As a result, the entire screen 2 can be rolled up, whereby the rollup shaft 3 essentially moves horizontally in the direction of the second edge 7 until the screen 2 is rolled up.

Hereby there is no sliding movement of the screen 2 along the edge of the whirlpool bath 8 either.

During the rollup movement, due to the weight of the rollup shaft 3 with the screen 2, the lamellae 4, which have a curve in the rolled out position, are pressed straight, so that the screen 2 can be rolled up relatively compactly.

In the embodiment described above, a drive belt 49 is shown for the drive of the gearwheels 31 at the supports 28, 29. It goes without saying that this alternative can be constructed with a chain and gearwheels.

Figure 13:
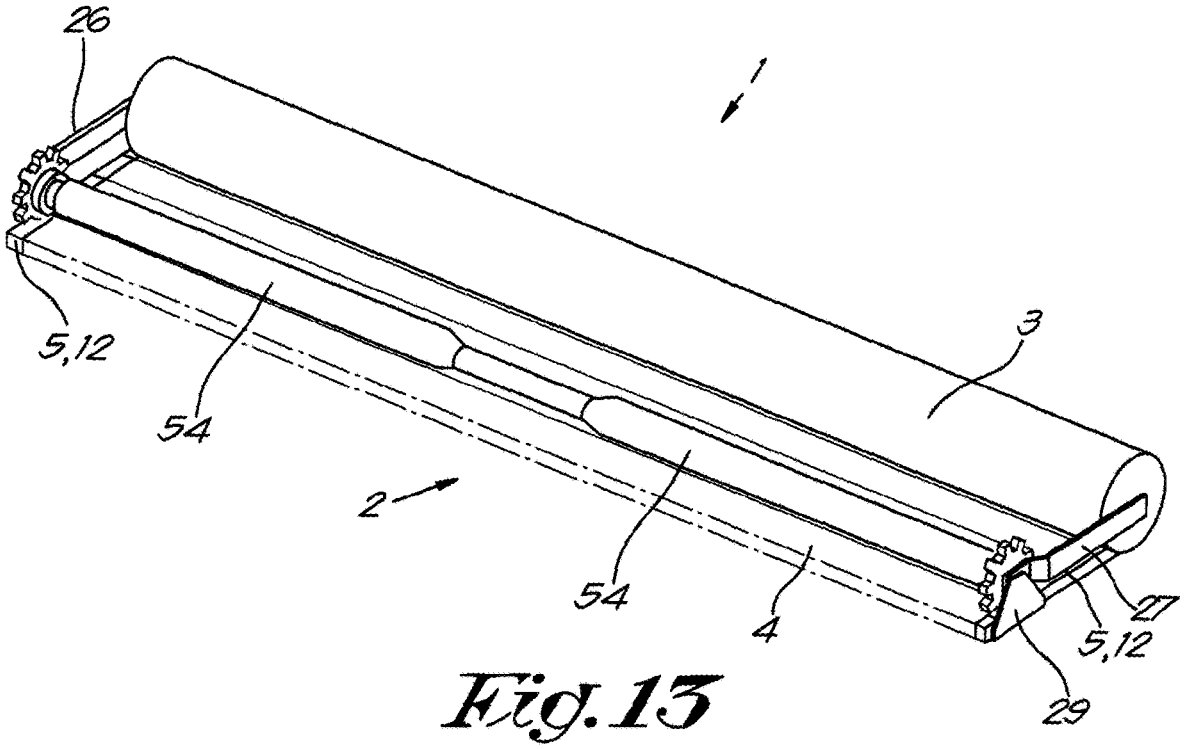
FIG. 13 shows a first alternative embodiment of a cover according to the invention.

The first alternative embodiment shown in FIG. 13 differs from the embodiment described above as follows.

A switched coupling 38 is not provided. The rotor 37 can thus drive the rollup shaft 3 in both directions.

This also means that there are no pulleys 48 and drive belt 49 at the second arm 27.

To nevertheless prevent the screen 2 coming loose around the rollup shaft 3 during a rollout movement, two springs are provided in a housing 54 around the connecting shaft 33 that are coupled to the gearwheels 31. These springs are tensioned upon a rollup movement of the screen 2 and thereby drive the gearwheels during a rollout movement and thereby supply a supplementary horizontal force to the rollup shaft 3 in the direction from the second edge 7 to the first edge 6.

It is also possible to construct the springs strongly enough to be able to drive the entire rollout movement. Hereby the electric motor 25 must be equipped to freewheel in the event of such a rollout movement, so that no extra resistance has to be overcome.

Figure 14:
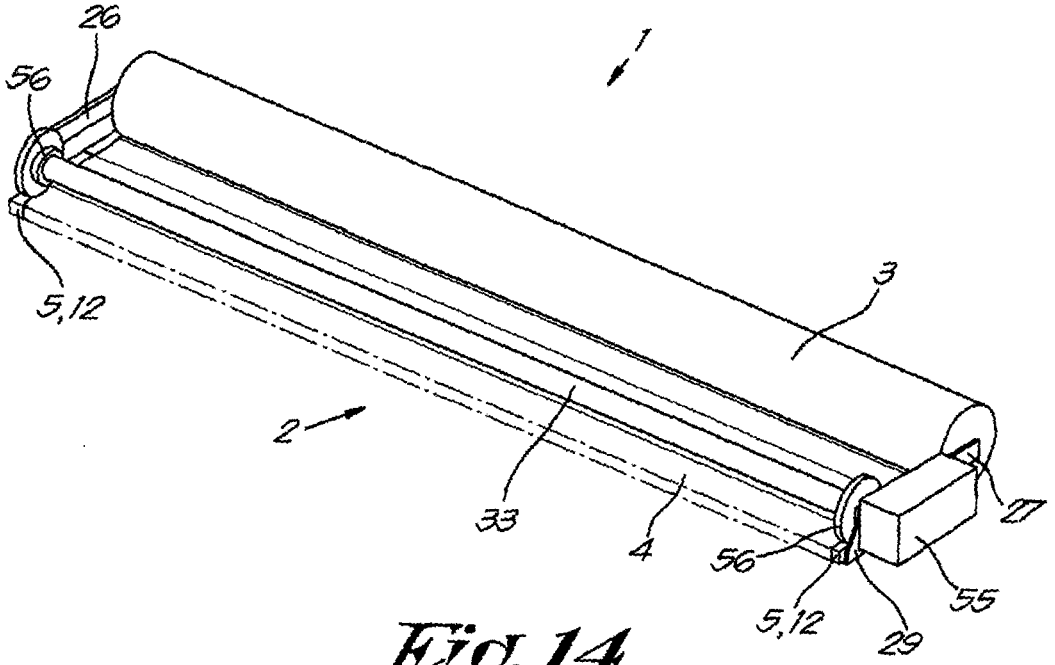
FIG. 14 shows a second alternative embodiment of a cover according to the invention.

The second alternative embodiment shown in FIG. 14 differs from the first alternative embodiment by no springs being provided. Instead of this a supplementary electric motor 55 is provided that drives wheels 56.

These wheels 56 are an alternative for the gearwheels 31 in the embodiments described earlier and have a rubber tread for better grip on the side edges 5 of the screen 2.

These wheels 56 are arranged to freewheel in the event of a rollup movement of the screen 2, and to provide an extra drive force, analogous to the springs in the first alternative embodiment, upon a rollout movement of the screen 2.

The present invention is by no means limited to the embodiments described as an example and shown in the drawings, but a cover according to the invention can be realised in all kinds of forms and dimensions without departing from the scope of the invention.

The invention claimed is:

1. A cover for a swimming pool or whirlpool bath, the cover comprising:

a rollup screen made of lamellae located next to one another and connected together with a hinge, the screen having two side edges formed by ends of the lamellae, the screen having a first edge perpendicular to the side edges and a second edge perpendicular to the side edges;

a rollup shaft, the first edge of the rollup screen being connected to the rollup shaft, the screen being configured to be rolled up and rolled out on the rollup shaft, the rollup shaft being horizontally movable so that the screen is configured to be rolled out while the second edge is in a fixed position; and a drive configured to exert a rotational force on the rollup shaft to thereby roll up the screen, wherein, during a rollup movement or rollout movement, the rollup shaft rests on the entirely or partially rolled-up screen and is thereby supported by the rolled-up screen, and the lamellae are connected together so that in use when resting in a flat position on a surface to be covered, the lamellae are configured to only hinge upwards in a direction away from the surface to the covered.

2. The cover according to claim 1, wherein the drive is formed by an electric motor with a rotor to drive the rollup shaft and a stator, the stator being connected via a first arm to a first support that is affixed to one of the side edges of the screen and which is movable over the one side edge.

3. The cover according to claim 2, wherein the rotor is connected in a rotational force-transmitting way to the rollup shaft in order to drive the rollup shaft during a rollup movement in which the stator is not rotatable with respect to the first support, the first support being affixed around the one side edge of the screen.

4. The cover according to claim 2, wherein the first support is at least partially under the one side edge so that the first support is blocked by the one side edge in relation to an upward movement.

5. The cover according to claim 2, wherein the first support is only connected to components of the cover.

6. The cover according to claim 2, wherein the cover does not comprise a rigid linear guide for guiding a horizontal movement of the first support.

7. The cover according to claim 2, wherein the rollup shaft is hollow and the electric motor is affixed in the rollup shaft.

8. The cover according to claim 1, wherein the rollup shaft is connected via a second arm to a second support that is affixed to one of the side edges of the screen and which is movable over the one side edge by at least one wheel that is affixed to the second support and which grips on the one side edge of the screen and which is driven in the direction from the second edge to the first edge.

9. The cover according to claim 8, wherein the at least one wheel is driven by the rotor of the electric motor, the electric motor being provided with a switched coupling to thereby alternately drive the rollup tube or the at least one wheel, depending on the direction of rotation of the rotor.

10. The cover according to claim 1, wherein the lamellae have a curve so that in the rolled out position, the screen has a downward incline towards the side edges with an average angle between 0.5° and 3°, whereby the lamellae are sufficiently elastically deformable to be brought to a straight position under tension.

11. The cover according to claim 1, wherein the lamellae have a curve due to having lamella bodies that are made of plastic in which fibers are affixed under tension in the longitudinal direction of the lamella bodies, and the average tension in the fibers on the underside of the lamella bodies is greater than in the fibers on the top of the lamella bodies.

12. The cover according to claim 1, wherein the lamellae are provided on their underside with a thermally conductive layer that extends over at least a section of the longitudinal direction of the lamellae.

13. The cover according to claim 1, wherein the underside of the lamellae are made of a soft deformable plastic.

14. The cover according to claim 1, wherein the lamellae are coupled together by a coupling of flexible plastic, the lamellae having a maximum width at a position lower than the coupling.

15. The cover according to claim 1, wherein, in use in relation to the swimming pool or the whirlpool bath, the lamellae of a rolled-up portion of the screen rests on side edges of the swimming pool or the whirlpool bath.

16. A whirlpool system, comprising:

a whirlpool bath having edges; and the cover according to claim 1 provided at the whirlpool bath, the cover being mounted such that the rollup shaft is horizontally moveable to be able to roll up or roll out the screen along the edges of the whirlpool bath through a horizontal movement of the rollup shaft, while the second edge of the screen is held at a fixed position.

17. The whirlpool system according to claim 16, wherein the whirlpool bath is not provided with a rail or other guide for guiding a rollup movement and/or rollout movement of the cover, which, independently of the rollup position of the cover, extends parallel to the two side edges.

18. The whirlpool system according to claim 16, wherein the drive is formed by an electric motor with a rotor to drive the rollup shaft and a stator, the stator being connected via a first arm to a first support that is affixed to one of the side edges of the screen and which is movable over the one side edge, the rotor being connected in a rotational force-transmitting way to the rollup shaft in order to drive the rollup shaft during a rollup movement whereby the stator is not rotatable with respect to the first support, the first support being affixed around the one side edge of the screen, wherein a first component of a closure is fastened on the first or the second support or the first or second arm, a second component of the closure being fastened to the whirlpool bath, the closure being configured to block a vertical movement of the first component with respect to the second component due to the first component being able to be introduced horizontally in or around or below the second component.

* * * * *